US009296202B2

(12) United States Patent
Abergel et al.

(10) Patent No.: US 9,296,202 B2
(45) Date of Patent: Mar. 29, 2016

(54) SUBSTANCE(S) DEPOSITION CONTROL DEVICE FOR OFFSET PRINTING SYSTEM AND METHOD FOR IMPLEMENTING THE DEVICE

(71) Applicants: MGI FRANCE, Ivry sur Seine (FR); INK JET TECHNOLOGY, Ivry sur Seine (FR)

(72) Inventors: Edmond Abergel, Paris (FR); Louis Gautier-Le-Boulch, Meudon (FR)

(73) Assignee: MGI FRANCE, Ivry sur Seine (FR)

( * ) Notice: Subject to any disclaimer, the term of this patent is extended or adjusted under 35 U.S.C. 154(b) by 0 days.

(21) Appl. No.: 14/398,812

(22) PCT Filed: May 7, 2013

(86) PCT No.: PCT/EP2013/059541
§ 371 (c)(1),
(2) Date: Nov. 4, 2014

(87) PCT Pub. No.: WO2013/167627
PCT Pub. Date: Nov. 14, 2013

(65) Prior Publication Data

US 2015/0114244 A1 Apr. 30, 2015

(30) Foreign Application Priority Data

May 7, 2012 (FR) ..... 12 54183

(51) Int. Cl.
*B41F 1/16* (2006.01)
*B41F 35/06* (2006.01)
*B41J 2/005* (2006.01)

(52) U.S. Cl.
CPC ..... *B41F 35/06* (2013.01); *B41J 2/0057* (2013.01)

(58) Field of Classification Search
CPC ..... B41J 2002/012
USPC ..... 101/492
See application file for complete search history.

(56) References Cited

U.S. PATENT DOCUMENTS 6,109,746 A * 8/2000 Jeanmaire ..... B41J 2/0057 347/103
2001/0054363 A1* 12/2001 Nakazawa ..... B41C 1/1066 101/465

(Continued)

FOREIGN PATENT DOCUMENTS

WO 2007/145378 12/2007

OTHER PUBLICATIONS

International Search Report for corresponding International Application No. PCT/EP2013/059541, mailed Jul. 25, 2013.

*Primary Examiner* — Anthony Nguyen
(74) *Attorney, Agent, or Firm* — Hauptman Ham, LLP

(57) ABSTRACT

The present invention relates to a substance(s) deposition control device for an offset printing system comprising at least one offset plate intended to receive at least one substance so as to transfer the substance or substances onto a substrate, at least one means for the controlled deposition of at least one substance, the deposition means comprising at least one head unit spraying at least one wetting solution and at least one head unit spraying at least one colored substance, at least one means for cleaning the offset plate. The covering of the offset plate comprises a mesh structure defined by a plurality of hydrophilic and lipophilic individual surfaces capable of receiving a controlled deposition of substance(s), each of these hydrophilic and lipophilic individual surfaces being separated from its direct neighbors by at least one hydrophobic and lipophobic peripheral surface. The invention also relates to a printing system incorporating the device and to a printing process implementing the device.

19 Claims, 5 Drawing Sheets

(56) References Cited

U.S. PATENT DOCUMENTS

2003/0038871 A1 2/2003 Shinkoda et al.
2003/0081043 A1* 5/2003 Klausbruckner ..... B41J 2/0057 347/22
2003/0159607 A1* 8/2003 Nitzan et al. ..... 101/466
2007/0165052 A1 7/2007 Sugahara
2007/0279473 A1* 12/2007 Tombs et al. ..... 347/107
2009/0027473 A1 1/2009 Taniuchi et al.
2009/0160920 A1* 6/2009 Badesha et al. ..... 347/88
2011/0132213 A1* 6/2011 DeJoseph ..... B41C 1/1066 101/130

* cited by examiner

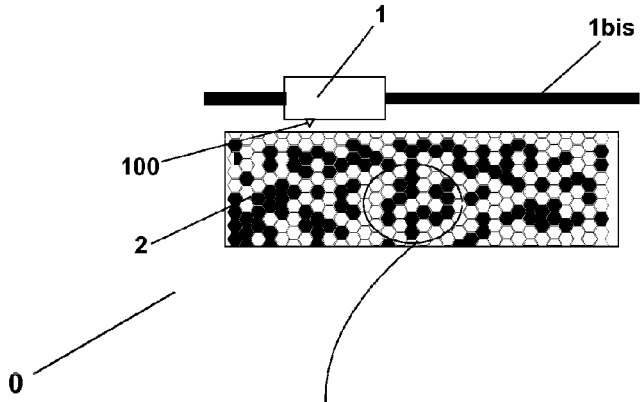
Figure 2
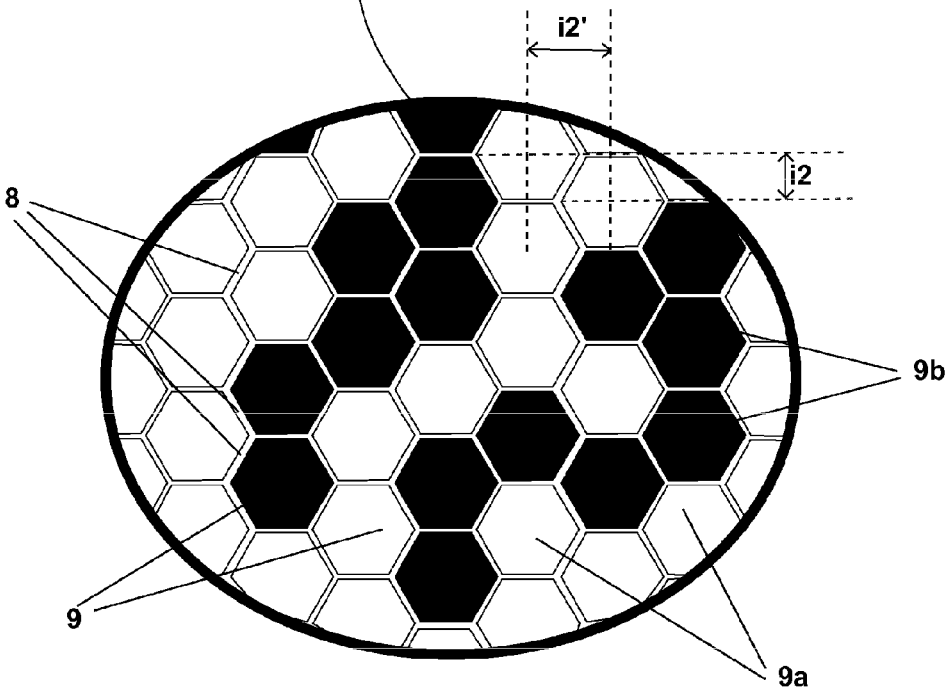
Figure 2bis

SUBSTANCE(S) DEPOSITION CONTROL DEVICE FOR OFFSET PRINTING SYSTEM AND METHOD FOR IMPLEMENTING THE DEVICE

CROSS-REFERENCE TO RELATED APPLICATIONS

This application is a National Stage Entry of PCT/EP2013/059541, filed May 7, 2013, which claims the priority benefit of French application no. 1254183, filed May 7, 2012.

BACKGROUND

The present invention relates to the field of offset printing systems and more particularly the field of devices for control of the deposit step of matter(s) for these printing systems.

Offset printing systems execute a major method among different current printing methods. This method flows directly from the earlier lithographic printing method, with the notable difference that it enables greater operating flexibility by allowing printing of several thousand copies on a wide variety of substrates (papers, polymer cartons . . . ). Lithographic printing methods are flat printing methods. It is considered here that offset printing methods utilise curved printing plates.

The principle of offset printing is based on the principle of water-grease repelling by creating an emulsion between an aqueous wetting solution and a greasy ink successively deposited on a plate etched in copper and aluminium known as offset. The etched plate comprises the image to be printed by the offset method. During the wetting step the aqueous solution is deposited to adhere to the aluminium parts of the surface of the plate, while during inking the greasy ink is repelled by the water on the copper parts of the plate. The ink now deposited on the offset plate is transmitted to an intermediate printing roller called a printing blanket, before being transferred to the definitive substrate. Such a printing technique has proven itself in terms of quality and enables production of a substantial quantity of printed substrate without alteration to the finish. However, this technique comprises the drawback of having an image to be printed which depends on etching of the offset plate. Also, if this technique limits printing wear over time, it does not mean any less a consequent cost when a piece of the machinery must be replaced. This cost is therefore important to each of the replacements of the etched offset plate, that is, sometimes when it breaks, but above all more commonly each time the image to be printed must be changed for printing a new image.

DESCRIPTION SUMMARY

The aim of the present invention is to eliminate this drawback of the prior art by proposing a device capable of carrying out printing which retains the advantages and the properties of the offset method but which also gains quick change of image and/or reduces production and manufacturing costs of machinery for printing a new image.

This aim is achieved by a matter(s) deposition control device for an offset printing system, comprising at least:

- an offset plate intended to receive at least one matter to transfer the matter(s) on a substrate,
- the device being characterized in that it further comprises:
- at least one controlled deposit means of at least one matter, the deposit means comprising at least one group of heads projecting at least one wetting solution and at least one group of heads projecting at least one coloured matter,

- at least one cleaning means of the offset plate, and in that the coating of the offset plate comprises a mesh structure defined by a plurality of hydrophilic and lipophilic unit surfaces likely to receive controlled deposit of matter(s), each of these hydrophilic and lipophilic unit surfaces being separated from its direct neighbours by at least one peripheral hydrophobic and lipophobic surface.

According to another particular feature, each group of heads comprises at least one head for depositing matter(s), each head comprising at least one nozzle controlled individually by a computer system and a digital file, each head being intended to project at least one matter on the surface of the offset plate so that all the projections produce an image and/or a text on the surface of the offset plate corresponding to the image and/or the text of the digital file for the heads of coloured matters and the negative of the image for the wetting solution heads.

According to another particular feature, the group(s) of wetting solution heads comprises at least one deposit head of a wetting solution comprising at least one nozzle projecting a wetting solution matter, the group(s) of heads of coloured matters comprising at least one deposit head per basic colour comprising each at least one nozzle projecting a matter of a different basic colour.

According to another particular feature, the group(s) of wetting solution heads comprising at least one deposit head comprising at least one nozzle projecting a wetting solution matter, the group(s) of heads of coloured matters comprising at least one deposit head comprising at least one nozzle per basic colour, each of the nozzles of the deposit head projecting a matter of a different basic colour.

According to another particular feature, the mesh structure comprises unit surfaces of rectangular form arranged relative to each other so as to form checkering of the surface.

According to another particular feature, the mesh structure comprises unit surfaces of hexagonal form arranged relative to each other so as to form a honeycomb meshing of the surface.

According to another particular feature, the value of the width of a peripheral lipophobic and hydrophobic surface corresponds to a value between 5% to 50% of the width of a lipophilic and hydrophilic unit surface.

According to another particular feature, the width of a unit surface likely to receive matter is at least equal to or greater than 35 μm.

According to another particular feature, the width of a unit surface likely to receive wetting liquid or the coloured matter is at least equal to 5 μm.

According to another particular feature, the offset plate is set in motion by displacement means, the displacement means setting the offset plate in motion incrementally between each deposit of matter(s) deposited by the nozzle(s) at the centre of at least one unit surface, each increment corresponding to the size of a demi-cell.

The invention also relates to a printing system on a substrate characterized in that it integrates a matter(s) deposition control device according to the invention.

According to another particular feature, the printing system further comprises a drying device intended to dry the matter(s) deposited on the substrate.

According to another particular feature, the substrate passes between the matter(s) deposition control device and a counterpressure cylinder.

According to another particular feature, the system comprises at least one printing blanket for each offset plate, the substrate passing between the counterpressure cylinder(s) and the printing blanket(s).

The invention also relates to a printing method implementing at least one matter(s) deposition control device according to the invention, comprising successively:

at least one controlled matter(s) deposit step on the offset plate comprising a plurality of lipophilic and hydrophilic surfaces separated by lipophobic and hydrophobic outlines by the nozzle(s) of the deposit means, at least one carryover step of the matter(s) on a substrate, at least one cleaning step by the cleaning means of the offset plate, characterized in that the controlled matter(s) deposit step comprises depositing matter(s) on at least one predefined point of the surface of the offset plate corresponding to the position of a point of the image to be defined or of the negative of the image.

According to another particular feature, the controlled matter(s) deposit step comprises:

a controlled deposit step of a wetting solution matter by the nozzle(s) projecting a wetting solution matter, a controlled deposit step of a matter of a basic colour by the nozzle projecting a matter of a basic colour, these steps being followed by the carryover step and the cleaning step, all of these steps being repeated for deposit of each matter of a different basic colour.

According to another particular feature, the controlled matter(s) deposit step comprises:

a controlled deposit step of a wetting solution matter by the nozzle(s) projecting a wetting solution matter, a controlled matter deposit step of each basic colour by the nozzles projecting a matter of different basic colour.

According to another particular feature, prior to the controlled matter(s) deposit step, the method comprises:

a preparation step of the image to be printed comprising at least determination and programming of the part(s) of the surface of the offset plate intended to receive the matter(s), a transfer step of programmed data corresponding to the image to be printed to the matter(s) deposition control device.

According to another particular feature, following the carryover step of the matter(s) to the substrate, the method comprises a drying step by a drying device of the matter(s) carried over to the substrate.

BRIEF DESCRIPTION OF THE SEVERAL VIEWS OF THE DRAWINGS

Other particular features and advantages of the present invention will emerge more clearly from the following description, given in reference to the appended drawings, in which:

FIG. 2 illustrates a profile view of the matter(s) deposition control device of the invention, FIG. 2*bis* illustrates a diagram of a detail of FIG. 2 according to an embodiment of the surface of the offset plate of the matter(s) deposition control device of the invention.

DESCRIPTION

Figure 1:
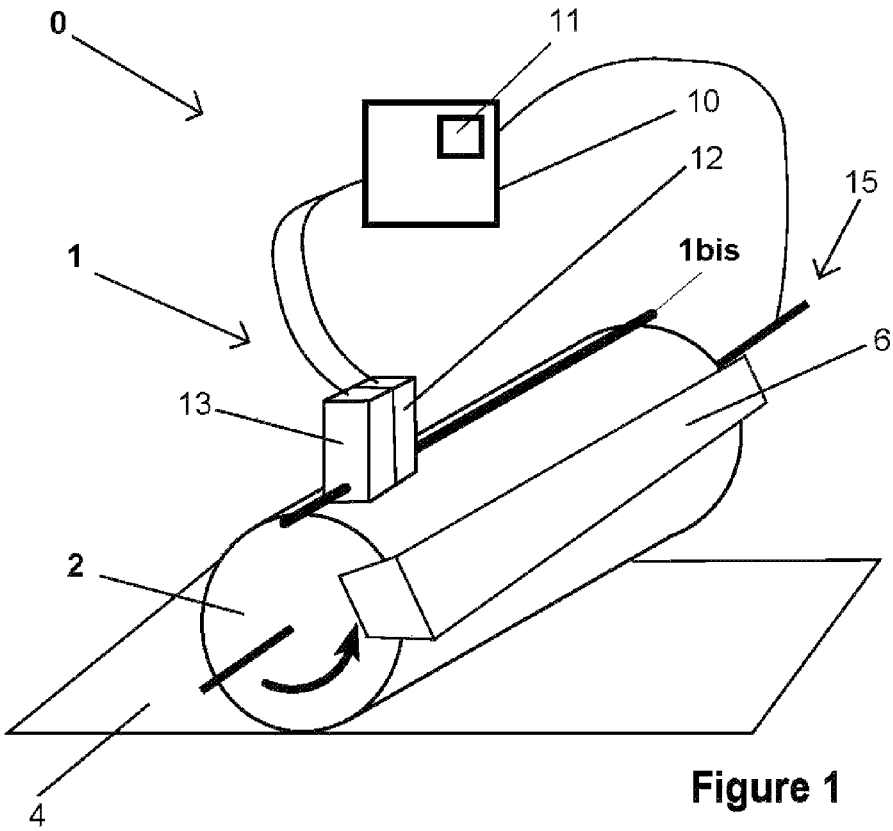
FIG. 1 illustrates a view in perspective of an embodiment of a matter(s) deposition control device according to the invention.

In the following, the term "matter" will designate any type of matter which can be sent by jet, such as for example and non-limiting, colours of any kind, varnishes, coating product, adhesives, wetting solutions . . . . For example, the wetting solution can be water. Matters of colour or coloured matters can be, for example, inks of different colours, for example basic colours such as cyan, yellow and magenta.

Similarly, the term "substrate" (4) should be understood in a wide sense, that is, as any type of flexible or rigid substrate adapted to operate with the printing system. These substrates can be types such as cellulosic (paper, carton, wood), composites, textiles or synthetics in continuous mode or sheet-fed mode and the thickness of which can vary from a few tens of micrometers to several centimeters.

The present invention retains the principle of the offset printing method based on the use of a universal offset plate (2) whereof the surface is arranged to receive and hold the deposit of a layer of matter(s) according to a predefined arrangement. Arrangement of the layer of matter on the surface of the plate is defined by controlled deposit and not only by etching of the surface of the offset plate (2). So, the device (0) for control of deposit of matter(s) is formed by the combination of two elements which enable both the precise deposit of the matter(s) on the surface of the offset plate (2) and also hold the arrangement of the matter(s) deposited on the offset plate (2).

The device (0) for control of depositing matter(s) of the invention is built with deposit means (1) adapted to precisely manage depositing of the matter(s) onto the surface of the offset plate (2).

This deposit means (1) of the matter(s) is formed for example by at least one group of heads comprising at least one head comprising at least one ejection nozzle (100). The ejection nozzle (100) can be for example a thermal nozzle utilising the phenomenon of vaporisation of the matter(s) which are then deposited on the surface of the offset plate (2). The matter(s) is/are deposited precisely on the offset plate (2). Each nozzle (100) is controlled individually by a computer system (10) and a digital file (11). Each head is intended to project at least one matter onto the surface of the offset plate (2) so that all the projections produce an image and/or a text on the surface of the offset plate (2) corresponding to the image and/or the text of the digital file (11).

In an embodiment, the deposit means (1) comprise at least one group of wetting solution heads comprising at least one deposit head (12) of a wetting solution. Each head comprises at least one nozzle projecting a wetting solution matter. In this embodiment, the deposit means (1) can further comprise at least one group of heads of coloured matters comprising at least one deposit head (13) per basic colour. Each head comprises each at least one nozzle projecting a matter of a different basic colour.

In another embodiment, the deposit means (1) comprises at least one group of heads of wetting solution comprising at least one deposit head (12) of a wetting solution. Each deposit head comprises at least one nozzle projecting a wetting solution matter. In this embodiment, the deposit means (1) can comprise at least one group of heads of coloured matters comprising at least one deposit head. Each head comprises at least one nozzle for each basic colour. Each of the nozzles of the deposit head projects a matter of a different basic colour.

The matter(s) deposition control device can be connected for example to at least one cleaning means (6) of the offset plate (2). This cleaning means (6) can be intended to retrieve the residue of projected matters remaining on the surface of the offset plate (2) and which has not been carried over to the substrate (4). This cleaning means (6) enables permanent cleaning of the surface of the offset plate prior to projection of new jets of matters. This cleaning means (6) can for example comprise a set of scrapers and rollers. Some rollers and scrapers could be in direct contact with the surface of the offset plate (2). The cleaning device (3) can also comprise blowing means such as for example a wind tunnel. As a function of the physicochemical characteristics of the projected matters, this set can be completed for example and non-limiting by water or solvents addition means, by heating means or cooling means. The cleaning means (6) of the matter(s) deposition control device can comprise a combination of these different devices so as to be polyvalent and be able to clean different types of matter residue.

The matter(s) deposition control device (0) also rests on the surface of the offset plate (2) which is arranged for precise holding of the matter(s) deposited on the surface of the plate. Keeping this precision is ensured by an offset plate (2) which comprises a universal surface adapted to interact with the deposited matter(s) by fixing it reversibly.

The offset plate (2) has a surface comprising a mesh structure of a plurality of hydrophilic and lipophilic unit areas (9), each of these unit areas being enclosed by a hydrophobic and lipophobic delimitation (8) or peripheral surface which separates it from its direct neighbours, also hydrophilic and lipophilic. Preferably, the surface of the offset plate (2) forms a mesh structure of hydrophilic and lipophilic unit areas (9) identical to each other and where each of them forms the smallest unit surface likely to receive controlled deposit of matter(s). Each of these hydrophilic and lipophilic unit areas (9) has a surface necessary and sufficient to receive at least one dose of matter(s) deposited by the deposit means (1). During deposit of the matter(s) by the deposit means (1), the nozzle(s) (100) of the deposit means (1) is positioned opposite a hydrophilic or lipophilic surface, for example by being centred on this surface, to project the matter(s) thereon.

According to a particular non-limiting embodiment feature, the group(s) of heads of the deposit means (1) of the matter(s) is mounted mobile along an axis (1*bis*) to allow lateral shifts in a width of the offset plate (2). Similarly, in a variant combinable with this particular embodiment feature, the axis which bears the group(s) of heads of the deposit means (1) can be mobile to allow displacement of the group(s) of heads in a length of the offset plate (2). This variant embodiment will be preferred when the offset plate (2) is built in the form of a flat structure.

In another particular embodiment feature, displacement of the group(s) of heads in the width of the offset plate (2) can be replaced by the use of a plurality of heads placed side by side and positioned to be opposite a respective deposit unit area (9). Similarly, displacement of the group(s) of heads in the length of the offset plate (2) can be replaced by displacement of the offset plate (2) itself, for example when the offset plate (2) is formed by the surface of a cylinder. The cylinder, when set in motion by rotation on its axis, enables displacement of the offset plate (2) relative to the group(s) of heads. The offset plate is set in motion by displacement means (15).

The deposit of matters on some of the unit areas (9) is predefined as a function of the image to be printed. Preparation of the image to be printed at the level of one or more adapted devices (10) may require programming, for example automated, of projection of the matter(s) in correlation with displacement of the group(s) of heads of the deposit device (1) relative to the offset plate (2) fitted with displacement means (15).

According to a particular embodiment feature, the mesh structure borne by the offset plate (2) is made from materials enabling confinement of matter(s) deposited on the surface of the unit areas and/or (sufficiently) uniform distribution on the surface of the unit areas, for example by way of metals having different lipophilic and hydrophilic properties, such as aluminium or copper, or for example by way of silicone.

The offset plate (2) has a surface comprising a mesh structure of a plurality of hydrophilic and lipophilic unit areas (9) capable of retaining or fixing a matter, respectively aqueous and greasy. Each of these areas is enclosed by an at least lipophobic peripheral area for repelling greasy matters such as ink. A peripheral hydrophilic area can also suit, such as glass or stainless steel for example, as it will be constantly wetted by the aqueous matter (i.e. the wetting solution) and will not be inundated by greasy matters. Preferably, a peripheral hydrophobic and lipophobic area (8) is used, capable of repelling the matter, respectively, greasy and aqueous, such as for example Teflon. In general, therefore the materials and/or the surface treatment of materials within the mesh structure of the offset plate are adapted as a function of the type of matter to be deposited, especially its surface tension, such that the unit areas confine the deposited matter (either wetting solution, or ink) and preferably the peripheral areas are not inundated by ink (greasy in this case).

According to a particular embodiment, the different unit areas (9) for fixing deposits of matter(s) are arranged on the surface of the offset plate (2) to form a mesh structure. This mesh structure positions the unit areas (9) relative to each other to allow a grid pattern which divides the entire surface of the offset plate (2) into a plurality of unit areas (9) respectively selected by the deposit means (1) of the matter(s).

Figure 3:
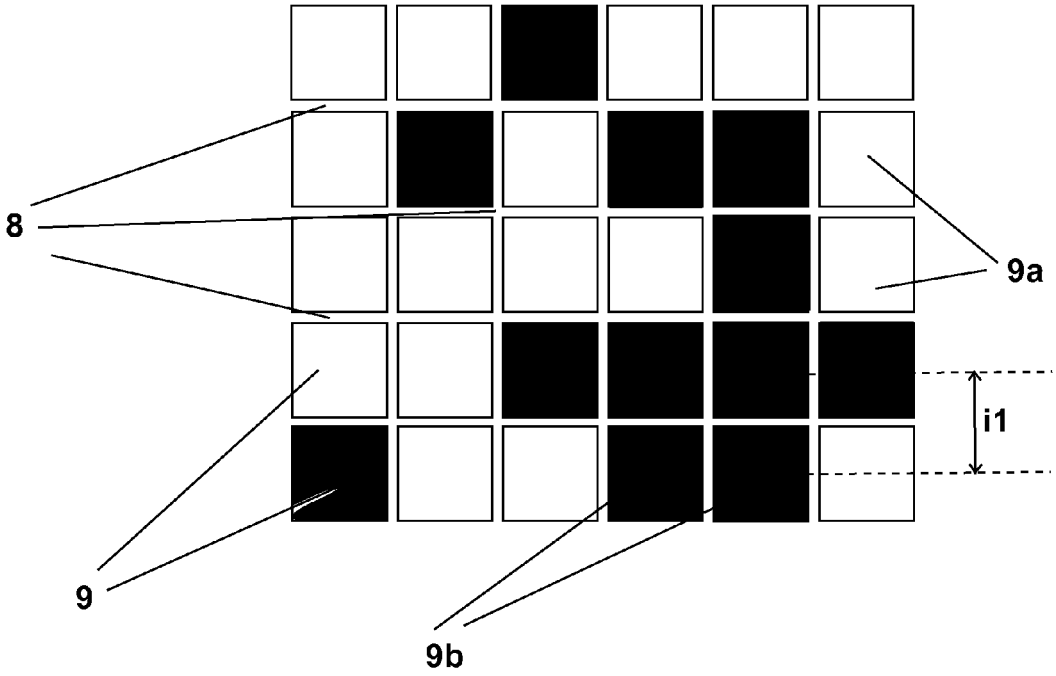
FIG. 3 illustrates a diagram according to another embodiment of the surface of an offset plate of the matter(s) deposition control device of the invention.
Figure 4:
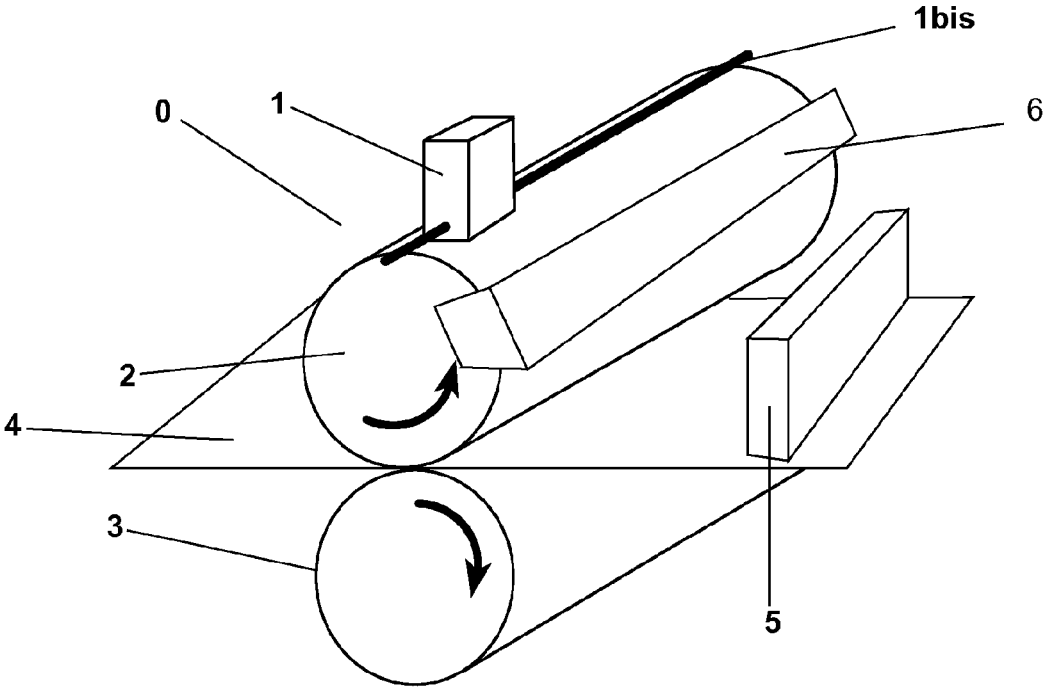
FIG. 4 illustrates a view in perspective of the printing system operating the matter(s) deposition control device of the invention.
Figure 5:
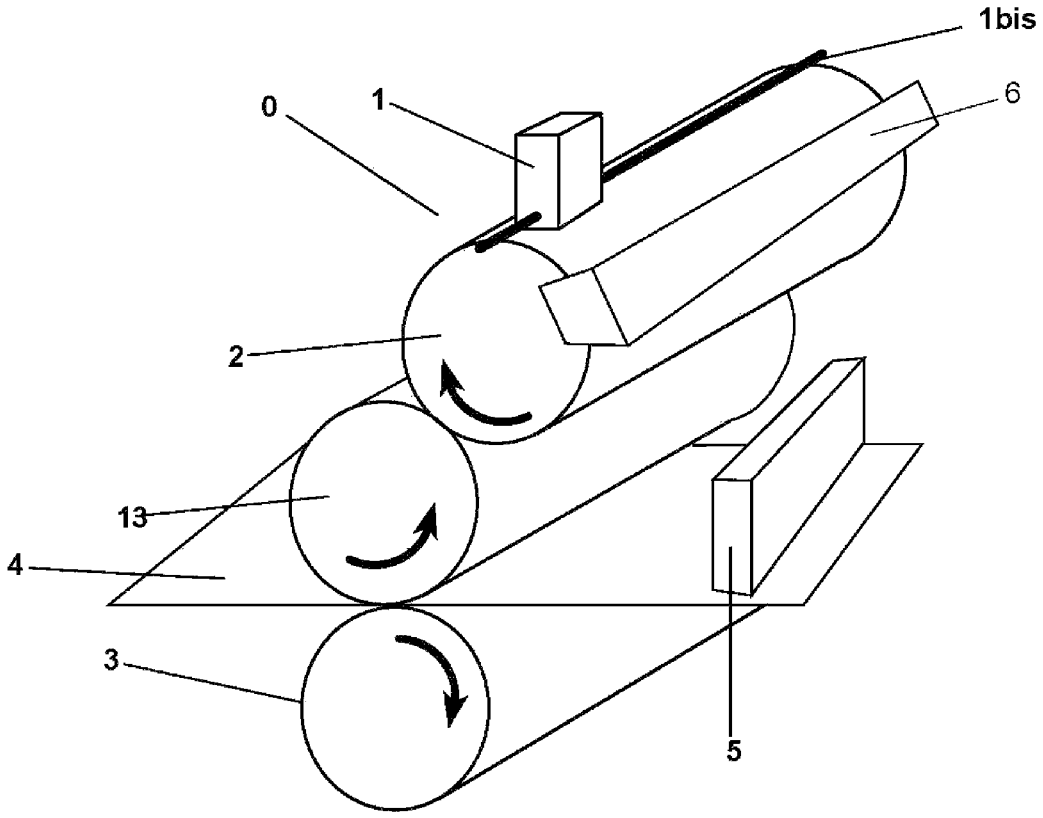
FIG. 5 illustrates a view in perspective of the printing system operating the matter(s) deposition control device of the invention.

In a non-limiting manner, according to a first variant of the embodiment of this mesh structure shown in FIG. 3, the unit areas (9) are of rectangular form, or even square, such that the mesh structure of the offset plate (2) forms checkering.

According to a second variant of the embodiment of this mesh structure shown in FIGS. 2 and 2*bis*, the different unit areas (9) present a hexagonal form to enable an arrangement which is a honeycomb. This second variant embodiment has the advantage of proposing unit areas the form of which is close to a circle. This form is better adapted to receive the deposit of a drop of matter. The hexagonal form of the different unit areas (9) on the offset plate (2) reconciles an arrangement of these different areas to allow an optimal mesh structure of the entire surface of the offset plate (2) and be adapted to the roundness of the drops of matter(s) which are likely to be deposited there.

In FIGS. 2, 2*bis* and 3, the cells (9*a*) on which the wetting solution has been deposited are filled in white and the cells (9*b*) on which has been deposited the coloured matter(s) are filled in black.

The different unit areas (9) on the surface of the offset plate (2) are separated by peripheral areas which can, for example, form a continuity together. Each of the unit areas (9) is enclosed by a peripheral area (8). According to a particular embodiment of the invention, a peripheral area (8) which separates two consecutive unit areas (9) has a width of between 5% and 50% of the width of a unit area (9). According to a particular embodiment feature, the peripheral areas (8) are arranged so that their width is both wide enough to individualise each of the unit areas and prevent depositing matter(s) from shifting from one unit area to another, and also restricted enough so that the repelling effect of the peripheral area on the matter(s) deposited on a unit area has a sufficient repelling effect to prevent the drop of matter(s) from spreading beyond the unit area on which it has been deposited. Similarly, the width of a unit area is of the order of at least 10 μm to 50 μm, preferably 20 μm to 40 μm, ideally 35 μm. This particular width produces a unit area which is adapted to optimally receive the deposit of at least one drop of matter(s). This width can also have a dimension of at least 5 μm.

The offset plate is set in motion by displacement means (15) which set in motion the offset plate incrementally between each depositing matter(s) deposited by the nozzle(s) at the centre of at least one unit surface. Each increment depends on the form of the unit area so that each unit area can face a nozzle projecting a wetting solution or a matter of colour. Each increment can correspond to the size of at least one demi-cell.

In the case of cells of rectangular form, each increment (i1) corresponds to the size of a cell.

In the case of cells of hexagonal form, each increment (i2) corresponds to the size of a demi-cell. In this case, there can be several variants. In a first variant, at each increment of the movement of the offset plate, the offset plate is shifted longitudinally by an increment (i2') of the size of a cell so that each nozzle is facing the centre of a unit surface. In a second variant, at each increment of the movement of the offset plate, the group or the groups of heads are shifted longitudinally and parallel to the offset plate by an increment (i2') of the size of a cell so that each nozzle is facing the centre of a unit surface. In a third variant, each group of heads has at least two nozzles separated by the size (i2') of a cell, one of the nozzles projecting matter at one increment and the other nozzle projecting matter at the following increment.

The aim of the device (0) for control of depositing matter(s) of the invention is to be integrated into a printing system which comprises especially at least one device for depositing matter(s) (3) and a pressure roller for transfer of the image from the surface of the offset plate (2) to the surface of a substrate (4).

The printing system can further comprise a drying device (5) intended to dry or polymerise the matter(s) deposited on the substrate (4) by the device according to the invention. The drying device (5) can be for example a source of heat or any other drying means placed after the device according to the invention. As per the characteristics of the matters used, the drying device (5) could for example and non-restrictively be a source of heat, a polymerisation system by ultraviolet, infrared, electron beams, or any other source of polymerisation. The advantage of drying by polymerisation is that a dry matter is produced without a lot of energy being expended. Also, the film of polymerising matter after polymerisation is highly resistant to abrasion, ageing, light, humidity . . . .

For easier transfer of matter(s) to the substrate (4), a counterpressure cylinder (3) is placed under the device according to the invention, the substrate (4) moving between the device according to the invention and the counterpressure cylinder (3). This counterpressure cylinder (3) plays a support role of the substrate (4) at the time of transfer of the depositing matter(s).

In an embodiment, the system can also comprise a printing blanket (14) placed between the offset plate (2*a*, 2*b*, 2*c*) and the substrate (4). The substrate (4) can pass between the printing blanket (14) and the counterpressure cylinder(s) (3*a*, 3*b*, 3*c*). The printing blanket (14) receives the coloured matter(s) and/or the wetting solution and transfers the received coloured matter(s) and/or the wetting solution to the substrate (4).

The method for executing the device of the invention comprises especially:

- at least one controlled matter(s) deposit step of the offset plate (2) by the nozzle(s) of the deposit means, that is, at the level of unit areas,
- at least one carryover step of the matter(s) to a substrate (4),
- at least one cleaning step by the cleaning means (6) of the offset plate (2).

The controlled deposit of matter(s) of the offset plate (2) can consist of a controlled matter(s) deposit step on unit areas of a wetting solution and a single colour prior to the transfer step of the ink to the substrate (4) or else depositing of matter(s) on successive unit areas of a wetting solution and several different colours. It should be recalled that the matter deposit step can be performed by one or more deposit nozzles as explained previously.

The wetting solution is projected by the nozzles into determined unit areas. The hydrophilic properties of the unit areas and the hydrophobic properties of the peripheral areas keep each wetting solution deposit in the unit area in which it has been deposited. The wetting solution is projected into the determined unit areas where the deposit of matters of colour which follows the deposit of the wetting solution is unwanted. The matters of colour can be, for example, greasy inks. Therefore, the lipophilic properties of the unit areas and the lipophobic properties of the peripheral areas keep each deposit of matters of colour in the unit area in which it has been deposited. Also, due to the water-grease repelling principle, the colour matters do not enter the unit areas where a wetting solution has been deposited.

In a first exemplary method, the method comprises several cycles. Each cycle comprises a controlled deposit step of a wetting solution matter by the nozzle(s) projecting a wetting solution matter. The controlled deposit step of a wetting solution matter can be followed by a controlled deposit step of a matter of a basic colour, for example ink of cyan colour, by the nozzle projecting a matter of a basic colour. The controlled deposit step of a matter of a basic colour can be followed by a carryover step of the wetting matter(s) and a basic colour to a substrate (4). The carryover step can be followed by a cleaning step of the offset plate (2) by the cleaning means (6). This cleaning removes all the matters which have not been carried over to the substrate (4), for example to start another cycle. The following cycle comprises the same steps but with controlled deposit of a different basic colour, for example an ink of magenta colour. Then, another cycle follows with controlled deposit of a different basic colour, for example yellow. Preferably, each cycle comprises a controlled deposit step of a basic colour but the controlled deposit of other colours which do not have to be basic colours can be considered. In this first exemplary method, for each cycle, the offset plate covers the same area of the substrate (4).

In a second exemplary method, the controlled matter(s) deposit step comprises a controlled deposit step of a wetting solution matter by the nozzle(s) projecting a wetting solution matter. The controlled deposit step of a wetting solution matter can be followed by a controlled deposit step of matter of each basic colour by the nozzles projecting a matter of basic colour. The matters of basic colours are, for example, several inks of different colours, for example, basic colours such as cyan, yellow and magenta. The combination of these basic colours produces a colour determined by the quantity of each basic colour. Therefore, for a determined colour, at least one nozzle (100) of each colour projects a quantity of ink in the same unit area to produce the preferred determined colour. The inks of each colour projected into this unit area mix during the trajectory between the final projection of ink and the carryover to the substrate (4).

Upstream of the controlled deposit step of the matter(s) of the offset plate (2), the method of the invention can also comprise:

a preparation step of the image to be printed comprising at least determination and programming of the part(s) of the surface of the offset plate (2) intended to receive matter(s), a transfer step of programmed data corresponding to the image to be printed to the device (0) for control of depositing matter(s).

Each nozzle (100) is controlled individually by a computer system (10) and a digital file (11). The digital file (11) determines the cells (9*a*) on which the wetting solution must be deposited and the cells (9*b*) on which the coloured matter(s) must be deposited so that all the projections produce an image and/or a text on the surface of the offset plate (2) corresponding to the image and/or au text of the digital file (11) for the heads of coloured matters and the negative of the image for the wetting solution heads.

Following the transfer step of the matter(s) on the substrate (4), the method comprises a drying step or polymerisation of the matter(s) carried over to the substrate (4) by the drying device (5) of the matter(s) carried over to the substrate (4).

It must be evident for those skilled in the art that the present invention enables embodiments in many other specific forms without departing from the field of application of the invention as claimed. Consequently, the present embodiments must be considered by way of illustration, but can be modified in the field defined by the scope of the appended claims, and the invention does not have to be limited to the details given hereinabove.

The invention claimed is:

1. A matter(s) deposition control device for an offset printing system comprising at least:

an offset plate configured to receive at least one matter to carry over the matter(s) to a substrate, the device further comprising:

at least one controlled deposit means of at least one matter, the at least one controlled deposit means comprising at least one group of heads projecting at least one wetting solution and at least one group of heads projecting at least one coloured matter, at least one cleaning means of the offset plate, and a coating of the offset plate, said coating comprising a mesh structure defined by a plurality of hydrophilic and lipophilic unit surfaces configured to receive controlled deposit of matter(s), each of these hydrophilic and lipophilic unit surfaces being separated from each other by at least one hydrophobic and lipophobic surface peripheral to each of the hydrophilic and lipophilic unit surfaces.

2. The matter(s) deposition control device according to claim 1, wherein each group of heads comprises at least one head for depositing matter(s), each head comprising at least one nozzle individually controlled by a computer system and a digital file, each head being configured to project at least one matter onto the surface of the offset plate so that all the projections produce an image and/or a text on the surface of the offset plate corresponding to the image and/or the text of the digital file for the heads of coloured matters and the negative of the image for the wetting solution heads.

3. The matter(s) deposition control device according to claim 1, wherein the group(s) of wetting solution heads comprises at least one deposit head of a wetting solution comprising at least one nozzle projecting a wetting solution matter, the group(s) of heads of coloured matters comprising at least one deposit head per basic colour each comprising at least one nozzle projecting a matter of a different basic colour.

4. The matter(s) deposition control device for an offset printing system according to claim 1, wherein the group(s) of wetting solution heads comprising at least one deposit head comprising at least one nozzle projecting a wetting solution matter, the group(s) of heads of coloured matters comprising at least one deposit head comprising at least one nozzle per basic colour, each of the nozzles of the deposit head projecting a matter of a different basic colour.

5. The matter(s) deposition control device for an offset printing system according to claim 1, wherein the mesh structure comprises unit surfaces of rectangular form arranged relative to each other so as to form checkering of the surface.

6. The matter(s) deposition control device for an offset printing system according to claim 1, wherein the mesh structure comprises unit surfaces of hexagonal form arranged relative to each other so as to form a honeycomb meshing of the surface.

7. The matter(s) deposition control device for an offset printing system according to claim 1, wherein the value of the width of a lipophobic and hydrophobic peripheral surface corresponds to a value of between 5% to 50% of the width of a lipophilic and hydrophilic unit surface.

8. The matter(s) deposition control device for an offset printing system according to claim 7, wherein the width of a unit surface configured to receive the matter is at least equal to or greater than 35 μm.

9. The matter(s) deposition control device for an offset printing system according to claim 1, wherein a width of a unit surface configured to receive wetting liquid or coloured matter is at least equal to 5 μm.

10. The matter(s) deposition control device for an offset printing system according to claim 1, wherein the offset plate is configured to be set in motion by displacement means, the displacement means setting in motion the offset plate incrementally between each deposit of matter(s) deposited by the nozzle(s) at the centre of at least one unit surface, each increment corresponding to the size of at least one demi-cell.

11. A printing system on a substrate comprising a matter(s) deposition control device comprising at least:

an offset plate configured to receive at least one matter to carry over the matter(s) to the substrate, the device further comprising:

at least one controlled deposit means of at least one matter, the at least one controlled deposit means comprising at least one group of heads projecting at least one wetting solution and at least one group of heads projecting at least one coloured matter, at least one cleaning means of the offset plate, and a coating of the offset plate, said coating comprising a mesh structure defined by a plurality of hydrophilic and lipophilic unit surfaces configured to receive controlled deposit of matter(s), each of these hydrophilic and lipophilic unit surfaces being separated from each other by at least one hydrophobic and lipophobic surface peripheral to each of the hydrophilic and lipophilic unit surfaces.

12. The printing system according to claim 11, wherein the printing system further comprises a drying device configured to dry the matter(s) deposited on the substrate.

13. The printing system according to claim 11, wherein the substrate passes between the device for control of depositing matter(s) and a counterpressure cylinder.

14. The printing system according to claim 11, wherein the system comprises at least one printing blanket for each offset plate, the substrate to be passed between the counterpressure cylinder(s) and the printing blanket(s).

15. A printing method operating a matter(s) deposition control device comprising at least:

an offset plate configured to receive at least one matter to carry over the matter(s) to a substrate, the device further comprising:

at least one controlled deposit means of at least one matter, the at least one controlled deposit means comprising at least one group of heads projecting at least one wetting solution and at least one group of heads projecting at least one coloured matter, at least one cleaning means of the offset plate, wherein the at least one group of heads comprises at least one head comprising a nozzle, and a coating of the offset plate, said coating comprising a mesh structure defined by a plurality of hydrophilic and lipophilic unit surfaces configured to receive controlled deposit of matter(s), each of these hydrophilic and lipophilic unit surfaces being separated from each other by at least one hydrophobic and lipophobic surface peripheral to each of the hydrophilic and lipophilic unit surfaces, comprising successively:

depositing, via at least one controlled matter(s) deposit step, on the offset plate comprising a plurality of lipophilic and hydrophilic surfaces separated by lipophobic and hydrophobic outlines by the at least one nozzle of the deposit means, carrying over, via at least one carryover step, of the matter(s) to a substrate, cleaning, via at least one cleaning step, by the cleaning means of the offset plate, wherein the controlled matter(s) deposit step comprises depositing matter(s) on at least one predefined point of the surface of the offset plate corresponding to the position of a point of the image to be defined or of the negative of the image, wherein the matter(s) deposition control device.

16. The printing method according to claim 15, wherein the controlled matter(s) deposit step comprises:

a controlled deposit step of a wetting solution matter by the nozzle(s) projecting a wetting solution matter, a controlled deposit step of a matter of a basic colour by the nozzle projecting a matter of a basic colour, these steps being followed by the carryover step and the cleaning step, all of these steps being repeated for deposit of each matter of a different basic colour.

17. The printing method according to claim 15, wherein the controlled matter(s) deposit step comprises:

a controlled deposit step of a wetting solution matter by the nozzle(s) projecting a wetting solution matter, a controlled deposit step of matter of each basic colour by the nozzles projecting a matter of different basic colour.

18. The printing method according to claim 15, wherein, prior to the controlled matter(s) deposit step, the method comprises:

a preparation step of the image to be printed comprising at least determining and programming of the part(s) of the surface of the offset plate configured to receive the matter(s), a transfer step of programmed data corresponding to the image to be printed to the device for control of depositing matter(s).

19. The printing method according to claim 15, wherein, following the carryover step of the matter(s) on the substrate, the method comprises a drying step by a drying device of the matter(s) carried over to the substrate.

* * * * *